US009301556B2

(12) United States Patent
Koller et al.

(10) Patent No.: US 9,301,556 B2
(45) Date of Patent: Apr. 5, 2016

(54) VENTILATED MOTORCYCLE JACKET

(71) Applicant: Harley-Davidson Motor Company Group, LLC, Milwaukee, WI (US)

(72) Inventors: Robert Koller, West Bend, WI (US); Jason Berndt, Shorewood, WI (US)

(73) Assignee: Harley-Davidson Motor Company Group, LLC, Milwaukee, WI (US)

( * ) Notice: Subject to any disclaimer, the term of this patent is extended or adjusted under 35 U.S.C. 154(b) by 365 days.

(21) Appl. No.: 13/740,652

(22) Filed: Jan. 14, 2013

(65) Prior Publication Data

US 2014/0196192 A1 Jul. 17, 2014

(51) Int. Cl.

| | |
|---|---|
| ***A41D 3/02*** | (2006.01) |
| ***A41D 3/00*** | (2006.01) |
| *A41D 1/08* | (2006.01) |
| *A41D 27/28* | (2006.01) |

(52) U.S. Cl.

CPC .. *A41D 3/02* (2013.01); *A41D 3/00* (2013.01); *A41D 27/285* (2013.01); *A41D 1/084* (2013.01); *A41D 27/28* (2013.01); *A41D 2400/20* (2013.01); *A41D 2600/102* (2013.01)

(58) Field of Classification Search

CPC ... A41D 1/084; A41D 27/28; A41D 2400/20; A41D 2600/102

USPC ..... 2/69, 93, 97, 119, 267, 272, 94, DIG. 1, 2/108, 106

See application file for complete search history.

(56) References Cited

U.S. PATENT DOCUMENTS

| | | | | |
|---|---|---|---|---|
| 1,973,419 | A * | 9/1934 | Trageser | 2/93 |
| 2,715,226 | A | 8/1955 | Weiner | |
| 3,153,793 | A * | 10/1964 | Lepore | 2/93 |
| 4,608,715 | A | 9/1986 | Miller et al. | |
| 5,105,477 | A | 4/1992 | Golde | |
| 5,507,042 | A | 4/1996 | van der Slessen | |
| 5,642,526 | A | 7/1997 | Thompson | |
| 5,704,064 | A | 1/1998 | van der Sleesen | |
| 5,752,277 | A | 5/1998 | van der Sleesen | |
| 5,845,336 | A | 12/1998 | Golde | |
| 6,085,353 | A | 7/2000 | van der Sleesen | |
| 6,263,510 | B1 | 7/2001 | Bay et al. | |
| 6,792,621 | B2 | 9/2004 | Braun | |
| 6,795,976 | B1 | 9/2004 | van der Sleesen | |
| 6,868,557 | B1 | 3/2005 | van der Sleesen | |
| 7,111,328 | B2 | 9/2006 | Bay | |
| 7,171,695 | B2 | 2/2007 | Braun | |

(Continued)

FOREIGN PATENT DOCUMENTS

| | | |
|---|---|---|
| DE | 69621322 | 1/2003 |
| JP | H10513233 | 12/1998 |
| JP | 2004534913 | 11/2004 |

*Primary Examiner* — Khaled Annis

(74) *Attorney, Agent, or Firm* — Michael Best & Friedrich LLP

(57) ABSTRACT

A ventilated jacket includes a front, a back, side portions, and sleeve portions. A vent system including a first vent, a second vent, and a third vent is disposed on each side portion. Each first vent extends from the side portion onto at least a portion of the corresponding sleeve and is movable between open and closed positions via a first fastening member. Each second vent is disposed in the side portion forward of the corresponding first vent and is movable between an open position and a closed position via a second fastening member. Each third vent is disposed in the side portion rearward of the corresponding first vent and is movable between an open position and a closed position via a third fastening member.

16 Claims, 4 Drawing Sheets

(56) References Cited

U.S. PATENT DOCUMENTS

| | | | | |
|---|---|---|---|---|
| 7,284,282 | B2 | 10/2007 | Bay | |
| 7,540,037 | B1 | 6/2009 | Bittler et al. | |
| 7,954,173 | B2 | 6/2011 | Collier | |
| 7,966,668 | B2 | 6/2011 | Bay | |
| 8,001,618 | B2 | 8/2011 | Bay | |
| 2003/0138586 | A1* | 7/2003 | Fowler | 428/57 |
| 2006/0277652 | A1* | 12/2006 | Okajima | 2/93 |
| 2006/0277653 | A1* | 12/2006 | Okajima | 2/93 |
| 2008/0196140 | A1* | 8/2008 | Mayerson et al. | 2/84 |
| 2008/0263743 | A1 | 10/2008 | Maurer | |
| 2009/0077710 | A1* | 3/2009 | Bay | 2/87 |
| 2009/0265829 | A1 | 10/2009 | Gomes Seguin et al. | |
| 2010/0299798 | A1* | 12/2010 | Fayle et al. | 2/69 |

* cited by examiner

VENTILATED MOTORCYCLE JACKET

BACKGROUND

The present invention relates to ventilated jackets, and more specifically, to a ventilated motorcycle jacket.

SUMMARY

In one aspect, the invention provides a ventilated jacket. The ventilated jacket includes a front portion, a back portion opposite the front portion, left and right side portions, and left and right sleeve portions. Each side portion extends between the front portion and the back portion, and each sleeve portion extends from one of the side portions. A left vent system is disposed on the left side portion of the jacket, and a right vent system is disposed on the right side portion of the jacket. The left vent system and the right vent system each include a first vent, a second vent, and a third vent. Each first vent extends from the corresponding side portion onto at least a portion of the corresponding sleeve portion and is movable between an open position and a closed position via at least one first fastening member. The first vents are configured to allow air flow when in the open position. Each second vent is disposed in the corresponding side portion forward of the corresponding first vent and is movable between an open position and a closed position via at least one second fastening member. The second vents are configured to allow air flow when in the open position. Each third vent is disposed in the corresponding side portion rearward of the corresponding first vent and is movable between an open position and a closed position via at least one third fastening member. The third vents are configured to allow air flow when in the open position.

In another aspect, the invention provides a ventilated jacket. The ventilated jacket includes a front portion, a back portion opposite the front portion, left and right side portions, and left and right sleeve portions. Each side portion extends between the front portion and the back portion, and each sleeve portion extends from one of the side portions. A left vent system is disposed on the left side portion of the jacket, and a right vent system is disposed on the right side portion of the jacket. The left vent system and the right vent system each include a first vent, a second vent, and a third vent. Each first vent extends from the corresponding side portion onto at least a portion of the corresponding sleeve portion and is movable via at least one first fastening member between an open position that exposes a first mesh gusset and a closed position that conceals the first mesh gusset. Each second vent is disposed in the corresponding side portion forward of the corresponding first vent and is movable via at least one second fastening member between an open position that exposes a second mesh gusset and a closed position that conceals the second mesh gusset. Each third vent is disposed in the corresponding side portion rearward of the corresponding first vent and is movable via at least one third fastening member between an open position that exposes a third mesh gusset and a closed position that conceals the third mesh gusset. In each of the vent systems, a lateral distance from the second vent to the third vent is less than or equal to 9 inches, measured at a vertical position defined by a center point of the second vent.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
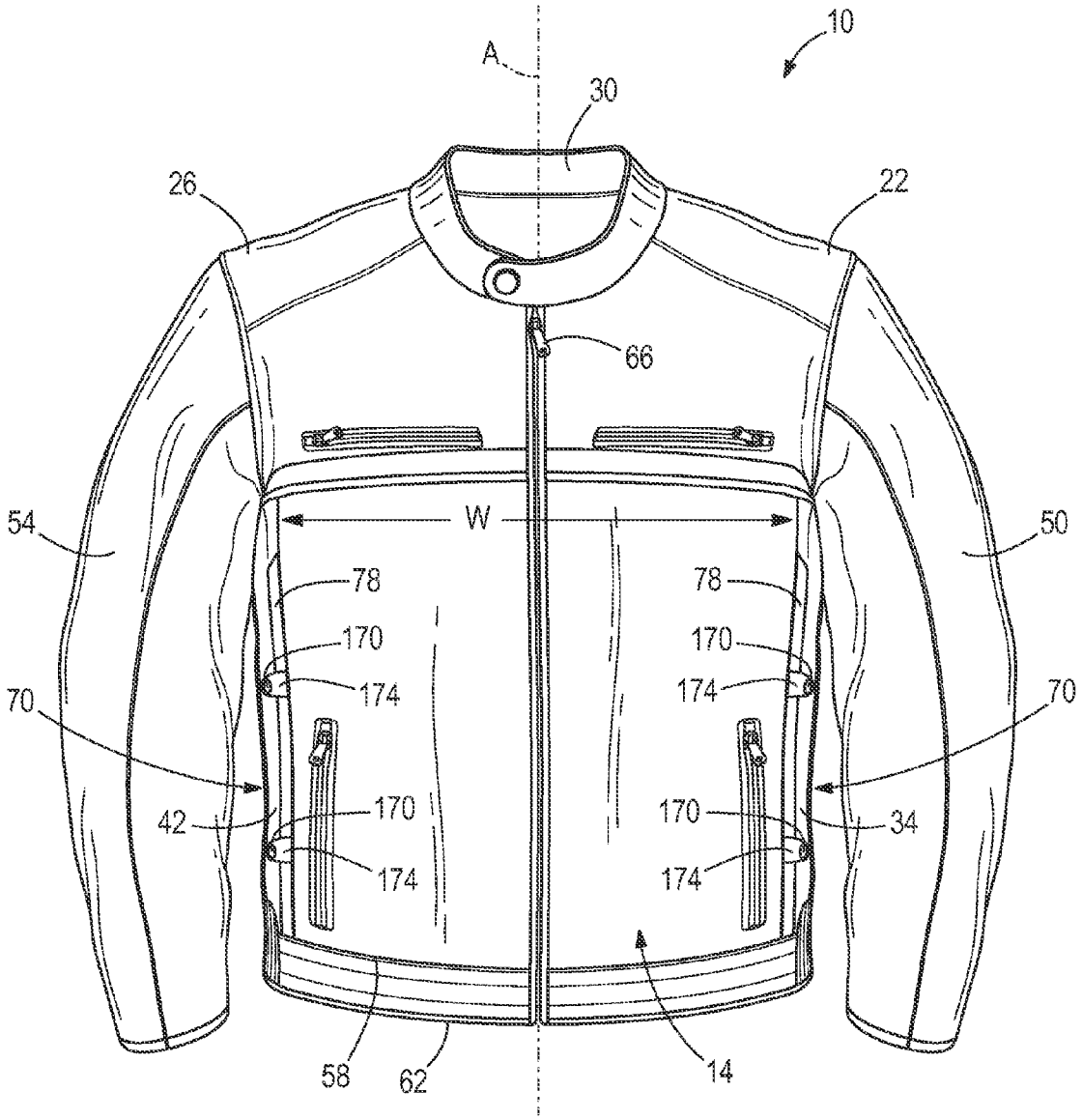
FIG. 1 is a front view of a ventilated jacket according to one embodiment of the present invention.

FIG. 1 illustrates a ventilated jacket 10. The ventilated jacket 10 is illustrated as a motorcycling jacket for use while operating a motorcycle. However, the ventilated jacket 10 may take different styles and may also be worn for activities other than motorcycling. The ventilated jacket 10 includes a forward-facing front portion 14 and a rearward-facing back portion 18 opposite the front portion 14. A left shoulder portion 22 and a right shoulder portion 26 extend between the front portion 14 and the back portion 18 adjacent a neck opening 30 of the ventilated jacket 10. A left side portion 34 extends between the front portion 14 and the back portion 18 on a left side of the jacket 10, and a right side portion 42 extends between the front portion 14 and the back portion 18 on a right side of the jacket 10. A left sleeve portion 50 extends from the left side portion 34, and a right sleeve portion 54 extends from the right side portion 42. A lateral width $W_S$ of each of the side portions 34, 42 is substantially smaller than a width W of either the front portion 14 or the back portion 18 (e.g., no more than about 50 percent of the width W of either the front portion 14 or the back portion 18). Defined another way, the lateral width $W_S$ of each side portion 34, 42 is no more than about one-sixth of the total jacket perimeter at a given height, such that the front and back portions 14, 18 together account for at least two-thirds of the total jacket perimeter at a given height.

A hem 58 is provided adjacent a bottom edge 62 of the ventilated jacket 10 and extends from the front portion 14 to the back portion 18. A main closure 66 (e.g., a zipper) extends through the front portion 14, enabling the jacket 10 to be in either a closed position as shown in FIG. 1 or an open position (for putting on and taking off the jacket 10). The main closure 66 is oriented substantially vertically, parallel to a central jacket axis A that extends through the neck opening 30 and the waist opening defined by the bottom edge 62, but other orientations are optional. The jacket 10 can be made of leather, synthetic leather, nylon, polyester, or other textile materials, or combinations thereof.

Figure 2:
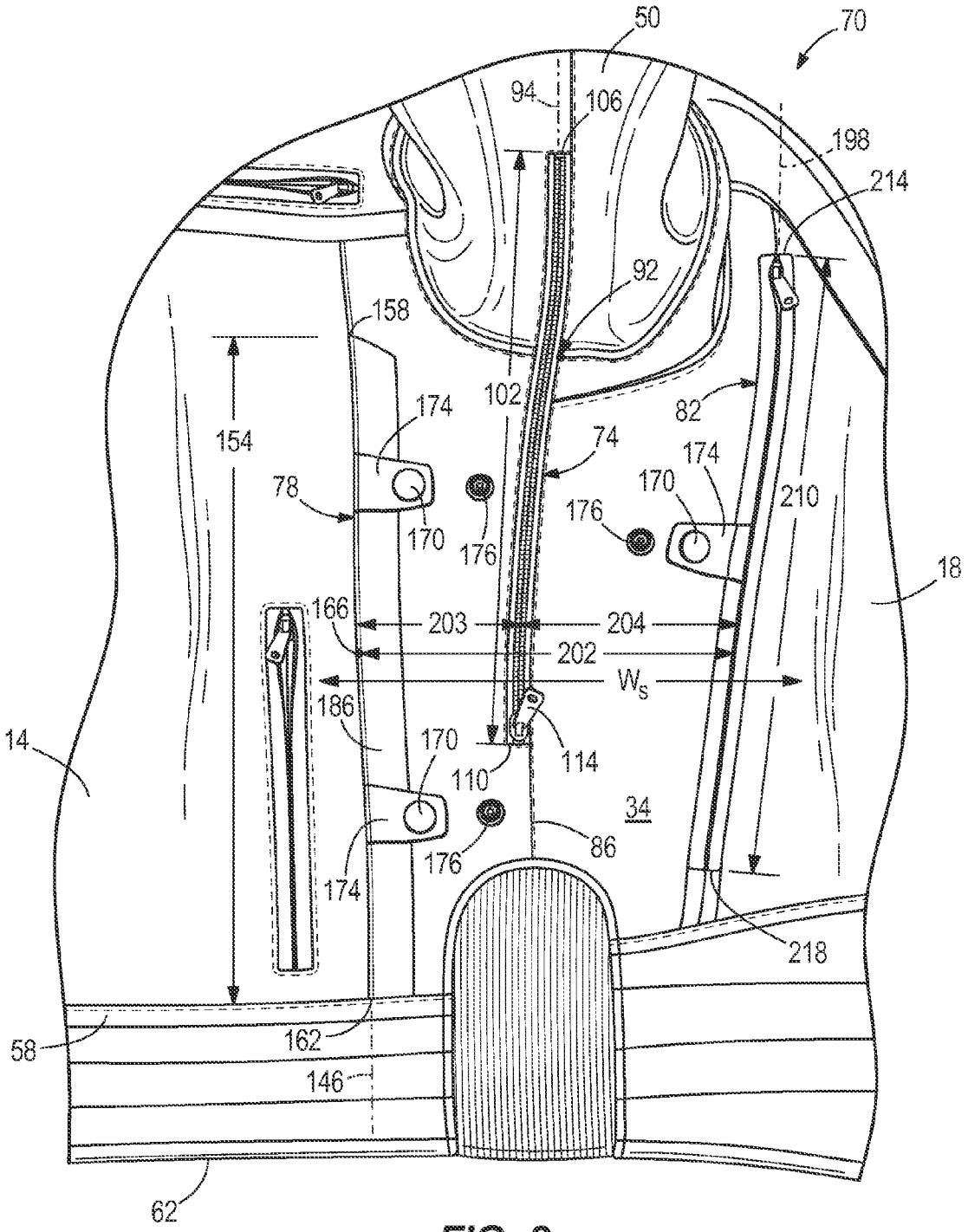
FIG. 2 is a left side view of an underarm portion of the ventilated jacket of FIG. 1, illustrating an underarm vent, a forward vent, and a rearward vent in closed positions.
Figure 3:
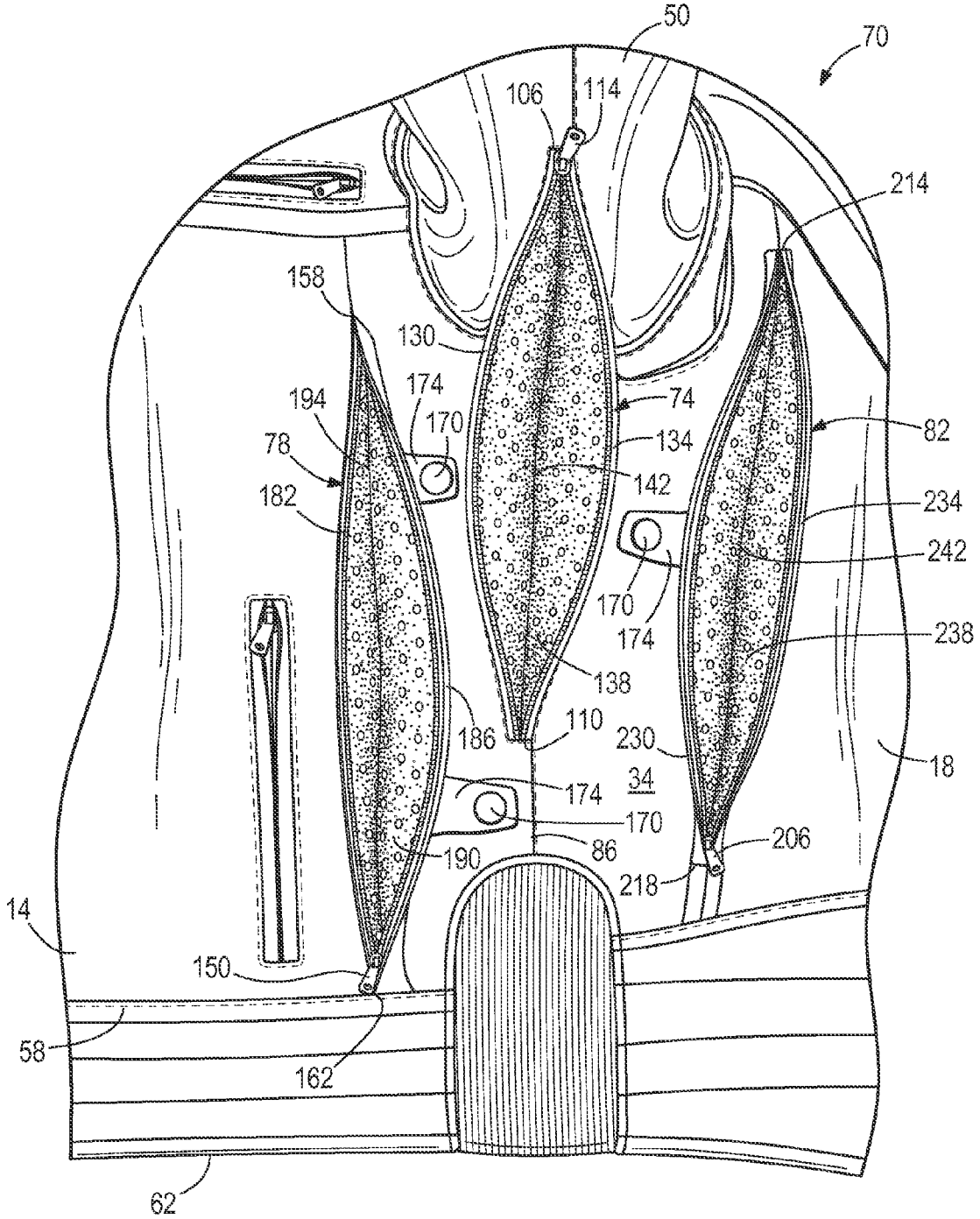
FIG. 3 is a left side view of the underarm portion of the ventilated jacket of FIGS. 1-2, illustrating the underarm vent, the forward vent, and the rearward vent in open positions.

Each side portion 34, 42 of the jacket 10 includes a vent system 70. FIGS. 2 and 3 illustrate the vent system 70 located on the left side of the jacket 10. The left vent system 70 includes an underarm vent 74, a forward vent 78, and a rearward vent 82, all of which are positioned at least partially within, and in some constructions entirely within, the left side portion 34 of the jacket 10. Although not shown in detail, a vent system 70 is also provided on the right side of the jacket 10. It should be understood that the vent system 70 on the right side of the ventilated jacket 10 is provided as a substantially identical mirror image of the left vent system 70, which is described in further detail below with reference to FIGS. 2 and 3.

Referring to FIG. 2, a left side seam 86 is provided on the left side portion 34 of the jacket 10 at a laterally outermost side edge of the jacket 10. The side seam 86 extends along a virtual line from a lowermost point of attachment 92 between the left sleeve portion 50 to a portion of the left side portion 34 directly below, toward the bottom edge 62. A portion of the underarm vent 74 is disposed along the seam 86 and the virtual line so as to define a substantially vertical first axis 94. However, the underarm vent 74 further extends from the left side portion 34 to at least a proximal part of the left sleeve portion 50. In the illustrated embodiment, the underarm vent 74 extends generally along the left side seam 86, but it will be understood that the underarm vent 74 extends generally along the virtual line if a side seam is not provided. The underarm vent 74 has a length 102 extending between a first or top end 106 and a second or bottom end 110. The length 102 can be about 8 inches to about 14 inches in some constructions. In the illustrated construction, the underarm vent 74 does not extend down to the bottom hem 58.

Figure 4:
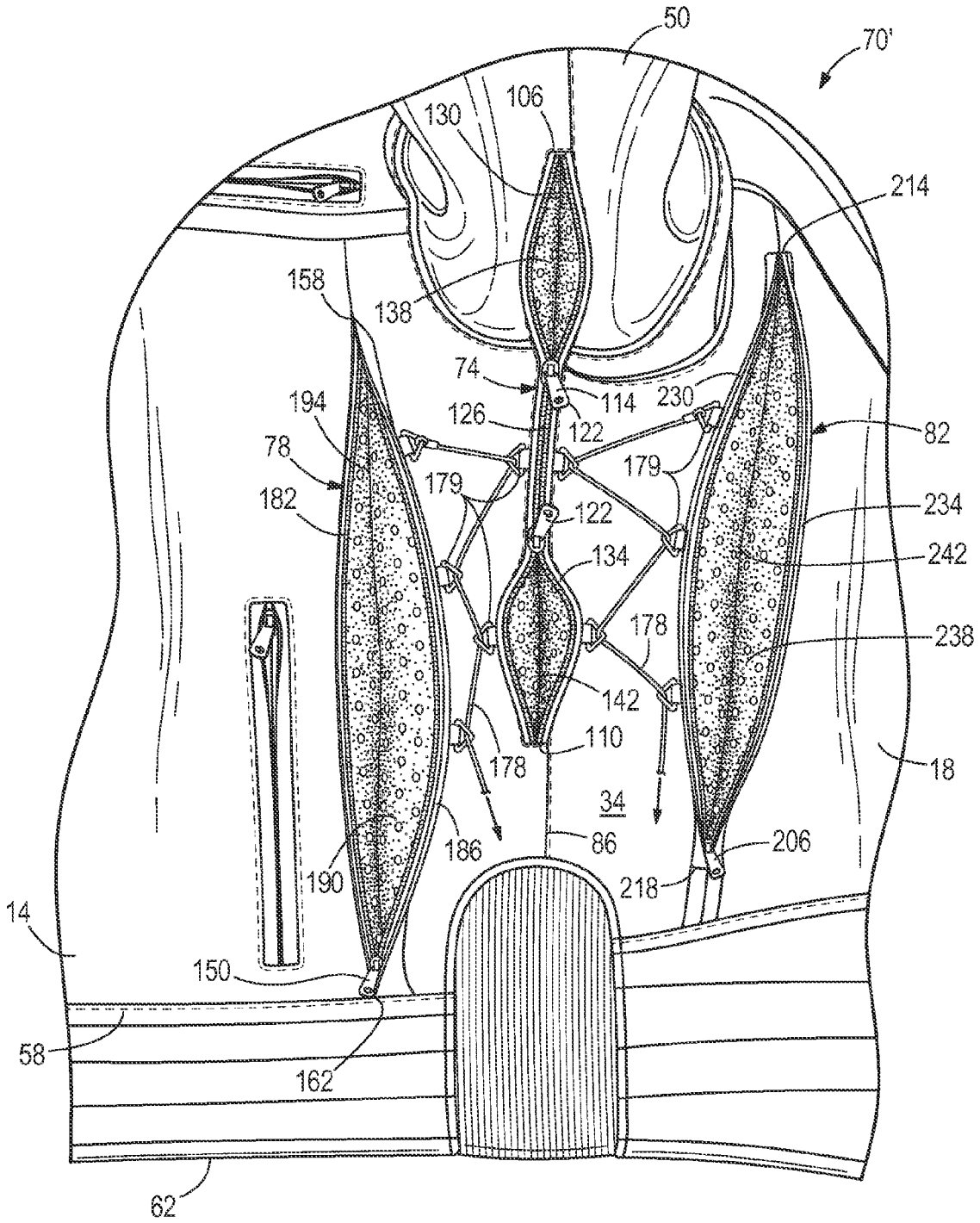
FIG. 4 is a left side view of an underarm portion of a ventilated jacket according to another embodiment of the present invention, illustrating a vent system including a lacing system.

The underarm vent 74 is movable between a closed position, as shown in FIG. 2, and an open position, as shown in FIG. 3, via at least one first fastening member 114. The underarm vent 74 is configured to allow air flow when in the open position. As illustrated in FIG. 2, the first fastening member 114 is a zipper, but other types of fastening members may be used instead of or in addition to the zipper. For example, in a venting system 70' of an alternate construction as shown in FIG. 4, the first fastening member 114 for the underarm vent 74 is a two-way zipper for additional opening configuration options. The two-way zipper includes two pull tabs 122 disposed along a single zipper track 126.

Referring to FIG. 3, the underarm vent 74 includes a first flap 130 and a second flap 134, which are selectively coupled together and released by the first fastening member 114. The underarm vent 74 includes a first mesh gusset 138 coupling the first flap 130 to the second flap 134. The first mesh gusset 138 is made of a perforated material, i.e., fabric, leather, etc. The first mesh gusset 138 includes a range of about 15 square inches to about 20 square inches of mesh area. The first mesh gusset 138 includes a central seam 142 configured to fold inward toward an interior of the jacket 10 to avoid getting caught in the first fastening member 114.

With reference to FIG. 2, the forward vent 78 is disposed entirely within the left side portion 34, towards the front portion 14 of the jacket 10. The forward vent 78 can be spaced a distance 203 between about 2 inches and about 5 inches forward of the underarm vent 74. The forward vent 78 extends along a substantially vertical second axis 146 to be substantially parallel to the central jacket axis A and the axis 94 of the underarm vent 74. Although substantially parallel, a slight angular offset (e.g., less than 10 degrees, and in some constructions, less than 5 degrees) may be present between the second axis 146 and the first axis 94 such that the lateral spacing distance 203 between the underarm vent 74 and the forward vent 78 changes (e.g., increases) a small amount in an upward direction.

The forward vent 78 is movable between a closed position, as shown in FIG. 2, and an open position, as shown in FIG. 3, via at least one second fastening member 150. The forward vent 78 is configured to allow air flow when in the open position.

In the illustrated construction, the second fastening member 150 is a zipper, but other types of fastening members may be used instead of or in addition to the zipper. Referring to FIG. 2, the forward vent 78 has a length 154 extending between a first or top end 158 and a second or bottom end 162. The length 154 can be about 10 inches to about 15 inches. The forward vent 78 has a center point 166 located halfway between the top end 158 and the bottom end 162. The bottom end 110 of the underarm vent 74 is positioned at a higher position on the jacket 10 than the bottom end 162 of the forward vent 78. Similarly, the top end 106 of the underarm vent 74 is at a higher position on the jacket 10 than the top end 158 of the forward vent 78.

Referring to FIG. 3, the forward vent 78 includes a first flap 182 and a second flap 186, which are selectively coupled together and released by the second fastening member 150. The forward vent 78 includes a second mesh gusset 190 coupling the first flap 182 to the second flap 186. The second mesh gusset 190 may be made of a perforated material, i.e., fabric, leather, etc. The second mesh gusset 190 includes a range of about 10 square inches to about 15 square inches of mesh area. The second mesh gusset 190 includes a central seam 194 configured to fold inward toward the interior of the jacket 10 to avoid getting caught in the second fastening member 150.

A supplemental opening device may be provided to pull the forward vent 78 closer to the underarm vent 74 to allow for greater air flow. As shown in FIGS. 1-3, the supplemental opening device includes a pair of snap members 170 mounted on corresponding tabs 174 coupled to the second flap 186 and engageable with snap members 176 fixed to the jacket side portion 34. In other constructions, the supplemental opening device may include a different number of snaps or an alternate type of coupling or closure device (e.g., laces 178 and eyelets 179 as shown in the alternate venting system 70' of FIG. 4) or a combination thereof. When the laces 178 and the eyelets 179 are used, each lace 178 is threaded through the corresponding eyelets 179 in a zig-zag fashion so that the forward vent 78 is pulled open toward the underarm vent 74 when the lace 178 is pulled tighter. The lace 178 can be secured in a desired position by a corresponding securing device on the inside or outside of the jacket 10.

As illustrated in FIG. 2, the rearward vent 82 is disposed entirely within the left side portion 34, towards the back portion 18 of the jacket 10. The rearward vent 82 can be spaced a distance 204 between about 2 inches and about 7 inches rearward of the underarm vent 74. The rearward vent 82 extends along a substantially vertical third axis 198 to be substantially parallel to the central jacket axis A and the axis 94 of the underarm vent 74. Although substantially parallel, a slight angular offset (e.g., less than 10 degrees, and in some constructions, less than 5 degrees) may be present between the third axis 198 and the first axis 94 such that the lateral spacing distance 204 between the underarm vent 74 and the rearward vent 82 changes (e.g., increases) a small amount in an upward direction.

The rearward vent 82 is positioned such that a lateral distance 202 from the forward vent 78 to the rearward vent 82 is less than or equal to 9 inches (e.g., about 7 inches), as measured at a vertical position defined by the center point 166 of the forward vent 78, which is about halfway between the bottom hem 58 and the lowermost point of attachment 92 of the sleeve portion 50 to the left side portion 34. At this height, a virtual lateral line intersects all three vents 74, 78, 82. At this height, the spacing distance 204 from the underarm vent 74 to the rearward vent 82 can be greater than the spacing distance 203 from the underarm vent 74 to the forward vent 78. For example, the spacing distance 204 from the underarm vent 74 to the rearward vent 82 can be about 5 inches or less and the spacing distance 203 from the underarm vent 74 to the forward vent 78 can be about 4 inches or less. It will be understood that measurements such as those mentioned above are taken with the vents 74, 78, 82 in the closed state, and without the jacket 10 being folded over.

The rearward vent 82 is movable between a closed position, as shown in FIG. 2, and an open position, as shown in FIG. 3, via at least one third fastening member 206. The rearward vent 82 is configured to allow air flow when in the open position. As illustrated in FIG. 2, the third fastening member 206 is a zipper, but may be an alternate fastening member. The rearward vent 82 has a length 210 extending between a first or a top end 214 and a second or a bottom end 218 of about 10 inches to about 15 inches. The bottom end 218 of the rearward vent 82 is positioned at a higher position on the jacket 10 than the bottom end 162 of the forward vent 78. Similarly, the top end 214 of the rearward vent 82 is at a higher position on the jacket 10 than the top end 158 of the forward vent 78. The orientation of the forward vent 78 relative to the rearward vent 82 allows for maximum air flow from an upwardly directed travelling wind (e.g., from underneath a fairing of a touring motorcycle), even if present only at the side of the jacket 10.

Referring to FIG. 3, the rearward vent 82 includes a first flap 230 and a second flap 234, which are selectively coupled together and released by the third fastening member 206. The rearward vent 82 includes a third mesh gusset 238 connecting the first flap 230 to the second flap 234. The third mesh gusset 238 may be made of a perforated material, i.e., fabric, leather, etc. The third mesh gusset 238 includes a range of about 10 square inches to about 15 square inches of mesh area. The third mesh gusset 238 includes a central seam 242 configured to fold inward toward the interior of the jacket 10 to avoid getting caught in the third fastening member 206.

The rearward vent 82 includes at least one supplemental opening device to pull the rearward vent 82 closer to the underarm vent 74 to allow for greater air flow. As shown in FIGS. 2 and 3, the supplemental opening device includes a snap member 170 mounted on a tab 174 coupled to the first flap 230 and engageable with a snap member 176 fixed to the jacket side portion 34. In other constructions, the supplemental opening device may include a different number of snaps or an alternate type of coupling or closure device (e.g., laces 178 and eyelets 179 as shown in the alternate venting system 70' of FIG. 4) or a combination thereof.

As shown in FIG. 2, the first axis 94, the second axis 146, and the third axis 198 all have a substantially upright orientation such that they do not overlap in any vertical line. The upright position is defined such that the spacing distances 203, 204 between the underarm vent 74 and each of the front vent 78 and the rearward vent 82 are always positive values as measured in a lateral direction. The underarm vent 74, the forward vent 78, and the rearward vent 82 are configured and oriented such that air flows in the underarm and forward vents 74, 78 and out the rearward vent 82 to provide ventilation to the wearer's body while operating a motorcycle or the like. The ventilated jacket 10 including a venting system 70, 70' as disclosed herein can be particularly useful in providing sufficient air flow to ventilate the inside of the jacket 10, even when the wearer of the jacket 10 is riding a motorcycle, such as a touring style motorcycle, that has a substantial amount of wind protection. The ventilated jacket 10 maximizes the amount of potential ventilation based on the available air flow around the sides of a touring style motorcycle by the placement and orientation of the vents 74, 78, 82 within the side portions 34, 42 of the jacket 10 as described above.

Various features and advantages of the invention are set forth in the following claims.

The invention claimed is:

1. A ventilated jacket comprising:

a front portion adapted to correspond to a user's front when worn;

a back portion opposite the front portion;

left and right side portions, each side portion extending between the front portion and the back portion;

left and right sleeve portions, each sleeve portion extending from a corresponding one of the left and right side portions;

a left vent system on the left side portion of the jacket; and a right vent system on the right side portion of the jacket, the left vent system and the right vent system each including a first vent, a second vent, and a third vent, wherein each first vent extends from the corresponding side portion onto at least a portion of the corresponding sleeve portion and crosses a joint between the side portion and the sleeve portion, such that first and second ends of each first vent are spaced away from the joint, each first vent being movable between an open position and a closed position via at least one first fastening member, the first vents configured to allow air flow when in the open position, wherein each second vent is disposed in the corresponding side portion forward of the corresponding first vent, each second vent being movable between an open position and a closed position via at least one second fastening member, the second vents configured to allow air flow when in the open position, and wherein each third vent is disposed in the corresponding side portion rearward of the corresponding first vent, each third vent being movable between an open position and a closed position via at least one third fastening member, the third vents configured to allow air flow when in the open position, wherein within each vent system, the first vent, the second vent, and the third vent define a first axis, a second axis, and a third axis, respectively, wherein the first axis extends parallel to a virtual line on the corresponding side portion of the jacket extending from a lowermost point of attachment between the sleeve portion and the corresponding side portion when worn to a point of the corresponding side portion directly below, toward a bottom edge of a waistline of the jacket, and wherein each of the second axis and the third axis is substantially parallel to the first axis such that an angular offset is less than 10 degrees from the first axis;

wherein a lateral distance between the first vent and one or both of the second and third vents increases in a direction from the waistline toward a neck opening of the jacket.

2. The ventilated jacket of claim 1, wherein each of the first vents, the second vents, and the third vents includes a corresponding mesh gusset selectively exposed or concealed by the corresponding first, second, and third fastening members.

3. The ventilated jacket of claim 1, wherein the first, second, and third vents of each vent system are arranged so that there is no overlap among any of the first, second, and third vents in a vertical direction when the jacket is worn.

4. The ventilated jacket of claim 1, wherein the second vents each include a top end and a bottom end and the third vents each include a top end and a bottom end, the bottom ends of the third vents being positioned higher than the bottom ends of the second vents.

5. The ventilated jacket of claim 4, wherein the top ends of the third vents are positioned higher than the top ends of the second vents.

6. The ventilated jacket of claim 1, wherein each of the left and right vent systems includes at least one supplemental opening member.

7. The ventilated jacket of claim 6, wherein the supplemental opening member includes at least one snap.

8. A ventilated jacket comprising:

a front portion adapted to correspond to a user's front when worn;

a back portion opposite the front portion;

a left side portion and a right side portion, each side portion extending between the front portion and the back portion;

left and right sleeve portions, each sleeve portion extending from a corresponding one of the left and right side portions;

a left vent system on the left side portion of the jacket; and a right vent system on the right side portion of the jacket, the left vent system and the right vent system each including a first vent, a second vent, and a third vent, wherein each first vent extends from the corresponding side portion onto at least a portion of the corresponding sleeve portion, each first vent being movable via at least one first fastening member between an open position that exposes a first mesh gusset and a closed position that conceals the first mesh gusset, wherein each second vent is disposed in the corresponding side portion forward of the corresponding first vent, each second vent being movable via at least one second fastening member between an open position that exposes a second mesh gusset and a closed position that conceals the second mesh gusset, wherein each third vent is disposed in the corresponding side portion rearward of the corresponding first vent, the third vent being movable via at least one third fastening member between an open position that exposes a third mesh gusset and a closed position that conceals the third mesh gusset, and wherein, in each of the vent systems, a lateral distance from the second vent to the third vent is less than or equal to 9 inches, measured at a vertical position defined by a center point of the second vent, wherein within each vent system, the first vent, the second vent, and the third vent define a first axis, a second axis, and a third axis, respectively, wherein the first axis extends parallel to a virtual line on the corresponding side portion of the jacket extending from a lowermost point of attachment between the sleeve portion and the corresponding side portion when worn to a point of the corresponding side portion directly below, toward a bottom edge of a waistline of the jacket, and wherein each of the second axis and the third axis is substantially parallel to the first axis such that an angular offset is less than 10 degrees from the first axis;

wherein a lateral distance between the first vent and one or both of the second and third vents increases in a direction from the waistline toward a neck opening of the jacket.

9. The ventilated jacket of claim 8, wherein each of the first, the second, and third mesh gussets include a central seam configured to fold inward toward an interior portion of the jacket.

10. The ventilated jacket of claim 8, wherein the first, second, and third vents of each vent system are arranged so that there is no overlap among any of the first, second, and third vents in a vertical direction when the jacket is worn.

11. The ventilated jacket of claim 8, wherein the second vents each include a top end and a bottom end and the third vents each include a top end and a bottom end, the bottom ends of the third vents being positioned higher than the bottom ends of the second vents.

12. The ventilated jacket of claim 11, wherein the top ends of the third vents are positioned higher than the top ends of the second vents.

13. The ventilated jacket of claim 8, wherein each of the left and right vent systems includes at least one supplemental opening member.

14. The ventilated jacket of claim 13, wherein the supplemental opening member includes at least one snap.

15. A ventilated jacket comprising:

a front portion adapted to correspond to a user's front when worn;

a back portion opposite the front portion;

left and right side portions, each side portion extending between the front portion and the back portion;

left and right sleeve portions, each sleeve portion extending from a corresponding one of the left and right side portions;

a left vent system on the left side portion of the jacket;

a right vent system on the right side portion of the jacket, the left vent system and the right vent system each including a first vent, a second vent, and a third vent;

a left seam on the left side portion of the jacket at a laterally outermost left side edge of the jacket, the left seam extending along a virtual line from a lowermost point of attachment between the left sleeve portion and the corresponding left side portion to a point of the left side portion directly below, toward a bottom edge of the jacket; and a right seam on the right side portion of the jacket at a laterally outermost right side edge of the jacket, the right seam extending along a virtual line from a lowermost point of attachment between the right sleeve portion and the corresponding right side portion when worn to a point of the right side portion directly below, toward the bottom edge of the jacket, wherein each first vent extends along the corresponding one of the right seam and the left seam from the corresponding side portion onto at least a portion of the corresponding sleeve portion, each first vent being movable between an open position and a closed position via at least one first fastening member, the first vents configured to allow air flow when in the open position, wherein each second vent is disposed in the corresponding side portion forward of the corresponding first vent, each second vent being movable between an open position and a closed position via at least one second fastening member, the second vents configured to allow air flow when in the open position, and wherein each third vent is disposed in the corresponding side portion rearward of the corresponding first vent, each third vent being movable between an open position and a closed position via at least one third fastening member, the third vents configured to allow air flow when in the open position, wherein within each vent system, the first vent, the second vent, and the third vent define a first axis, a second axis, and a third axis, respectively, wherein the first axis extends parallel to a virtual line on the corresponding side portion of the jacket extending from a lowermost point of attachment between the sleeve portion when worn and the corresponding side portion to a point of the corresponding side portion directly below, toward a bottom edge of a waistline of the jacket, and wherein each of the second axis and third axis is substantially parallel to the first axis such that an angular offset is less than 10 degrees from the first axis;

wherein a lateral distance between the first vent and one or both of the second and third vents increases in a direction from the waistline toward a neck opening of the jacket.

16. The ventilated jacket of claim 15, wherein each first vent crosses a joint between the corresponding side portion and the sleeve portion, such that first and second ends of each first vent are spaced away from the joint.

* * * * *